US006058852A

United States Patent [19]

Estvanko

[11] Patent Number: 6,058,852

[45] Date of Patent: May 9, 2000

[54] EQUIPMENT SKID

[76] Inventor: Gary A. Estvanko, 160 Grady Whitton Rd., Bremen, Ga. 30110

[21] Appl. No.: 09/310,115

[22] Filed: May 12, 1999

[51] Int. Cl.[7] ..... B65D 19/44

[52] U.S. Cl. ..... 108/55.3; 108/51.11; 108/57.32

[58] Field of Search ..... 108/57.3, 57.31, 108/57.32, 57.24, 55.5, 55.1, 51.11, 57.16

[56] References Cited

U.S. PATENT DOCUMENTS

| | | | |
|---|---|---|---|
| 1,690,873 | 11/1928 | O'Neil | 108/55.5 X |
| 2,614,688 | 10/1952 | Hammer . | |
| 2,626,456 | 1/1953 | Harrison . | |
| 2,828,007 | 3/1958 | Foss . | |
| 3,204,583 | 9/1965 | Nicholson . | |
| 3,294,041 | 12/1966 | Lessheim . | |
| 3,405,666 | 10/1968 | Miller . | |
| 3,430,585 | 3/1969 | Grant et al. . | |
| 3,430,586 | 3/1969 | Oswald . | |
| 3,616,766 | 11/1971 | Weiss | 108/57.32 X |
| 3,626,872 | 12/1971 | Cully | 108/55.5 X |
| 3,641,948 | 2/1972 | Brown . | |
| 3,654,876 | 4/1972 | Achs | 108/57.16 |
| 3,703,870 | 11/1972 | Walton | 108/51.11 |
| 3,753,407 | 8/1973 | Tilseth | 108/55.5 X |
| 3,776,145 | 12/1973 | Anderson et al. | 108/57.16 |
| 3,943,860 | 3/1976 | Brennan . | |
| 4,059,057 | 11/1977 | Carnwath . | |
| 4,230,050 | 10/1980 | Mays . | |
| 4,416,385 | 11/1983 | Clare et al. | 108/51.1 X |
| 4,735,153 | 4/1988 | Wong | 108/57.16 |
| 5,211,117 | 5/1993 | Beamer | 108/57.32 X |
| 5,809,907 | 9/1998 | Bumgarner | 108/51.11 |

FOREIGN PATENT DOCUMENTS

| | | | |
|---|---|---|---|
| 2036526 | 8/1992 | Canada . | |
| 2159650 | 6/1972 | Germany . | |
| 701869 | 12/1979 | U.S.S.R. | 108/55.5 |
| 973430 | 11/1982 | U.S.S.R. | 108/55.5 |
| 8600866 | 2/1986 | WIPO | 108/57.32 |

*Primary Examiner*—Jose V. Chen
*Attorney, Agent, or Firm*—Richard C. Litman

[57] ABSTRACT

A equipment skid for supporting heavy loads is fabricated from square metal tubing. The skid is provided with cross-tubes which provide additional strength and support. The cross-tubes are have openings at each end, which openings are sized to receive the tines of a fork-lift truck. A cage structure, constructed of angle irons, is positioned on the skid and functions to stabilize the heavy equipment supported on the skid.

7 Claims, 6 Drawing Sheets

EQUIPMENT SKID

BACKGROUND OF THE INVENTION

1. Field of the Invention

The present invention generally relates to material handling equipment. More specifically, the present invention is drawn to a heavy duty metal platform skid and frame structure that is adapted to be easily lifted and moved by a fork-lift truck.

2. Description of the Related Art

In the material-handling art, it is customary to load various articles and materials on platform skids for storage and/or transport. In most instances, a fork-lift truck is employed to lift the loaded skids and to move the same from the storage area to the place for transport and vice versa.

Moving and transporting heavy equipment such as electric generators has long been a problem in the art. Electric generators can weigh from 2,500 to 14,000 pounds. Prior art platform skids have proven to be grossly inadequate when supporting such weight, and in instances where the skids fail, significant damage may be done to the dropped generators. Also, the lack of stability of the prior art platform skids has allowed the generators to shift during transport causing damage to the floor and walls of the transporting vehicle. This is particularly critical when the transporting vehicle is an airplane.

Most platform skids are constructed of wood or cardboard. Examples of such platform skids are shown in U.S. Pat. Nos. 3,204,583 (Nicholson), 3,294,041 (Lessheim), 3,430,585 (Grant et al.), 3,641,948 (Brown), 4,059,057 (Carnwath), and 4,230,050 (Mays).

U.S. Pat. No. 2,828,007 (Foss) and German Patent number 2,159,650 disclose platforms which utilize metal corner pieces to provide strength and stability.

U.S. Pat. No. 2,626,456 (Harrison) shows a skid member designed to support bundles of ingots. The skid member is constructed of ingot material to eliminate the disposal or return of the skid member.

U.S. Pat. No. 3,405,666 (Miller) shows a skid constructed of plastic material.

U.S. Pat. Nos. 2,614,688 (Hammer), 3,430,586 (Oswald), 3,943,860 (Brennan), and Canadian Patent number 2,036,526 disclose skid structure made of relatively thin sheet metal.

None of the above inventions and patents, taken either singularly or in combination, is seen to disclose a metal, heavyduty platform skid and frame structure as will subsequently be described and claimed in the instant invention.

SUMMARY OF THE INVENTION

In the preferred embodiment, the present invention comprises a rectangularly shaped skid structure constructed from square metal tubing. The skid structure is provided with cross-tubes which serve as additional support and which open on each side of the skid. The openings in the cross-tubes are sized to receive the tines of a fork-lift truck. The cross-tubes are spaced so that balance is achieved when the skid is properly loaded and lifted. The ends of the skid structure are angled to prevent tip overs and damage to the floor of the transporting vehicle (airplane, semi, wheeled dolly, etc.). A vertically oriented angle iron is positioned adjacent each corner of the skid. The angle irons are equal in height. Adjacent vertical angle irons are connected by horizontally oriented angle irons, thus forming a cage structure enclosing and stabilizing the load i.e. generator. The vertical and horizontal angle irons are provided with tie-down arms whereby the cage structure may be secured to another like cage structure and/or secured to the walls and floor of the transporting vehicle. The elements of the skid and cage structure are bolted or welded together to form a rigid and stable support structure. The dimensions of the skid and cage (width, length, height) will be determined by the dimensions of the proposed load. Although originally designed to transport electrical generators, the above described structure could be utilized to transport a variety of heavy merchandise such as auto parts, furniture, concrete products, PORT-A-POTTIES etc.

Other embodiments and/or modifications of the present invention will be revealed in the drawings and detailed description below.

Accordingly, it is a principal object of the invention to provide a rugged platform skid capable of safely supporting heavy equipment for moving and storing.

It is another object of the invention to provide a rugged platform skid made of metal tubing.

It is a further object of the invention to provide a rugged platform skid which incorporates a stabilizing cage structure affixed thereto.

Still another object of the invention is to provide a rugged platform skid and cage structure which can be easily moved by a fork-lift truck.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
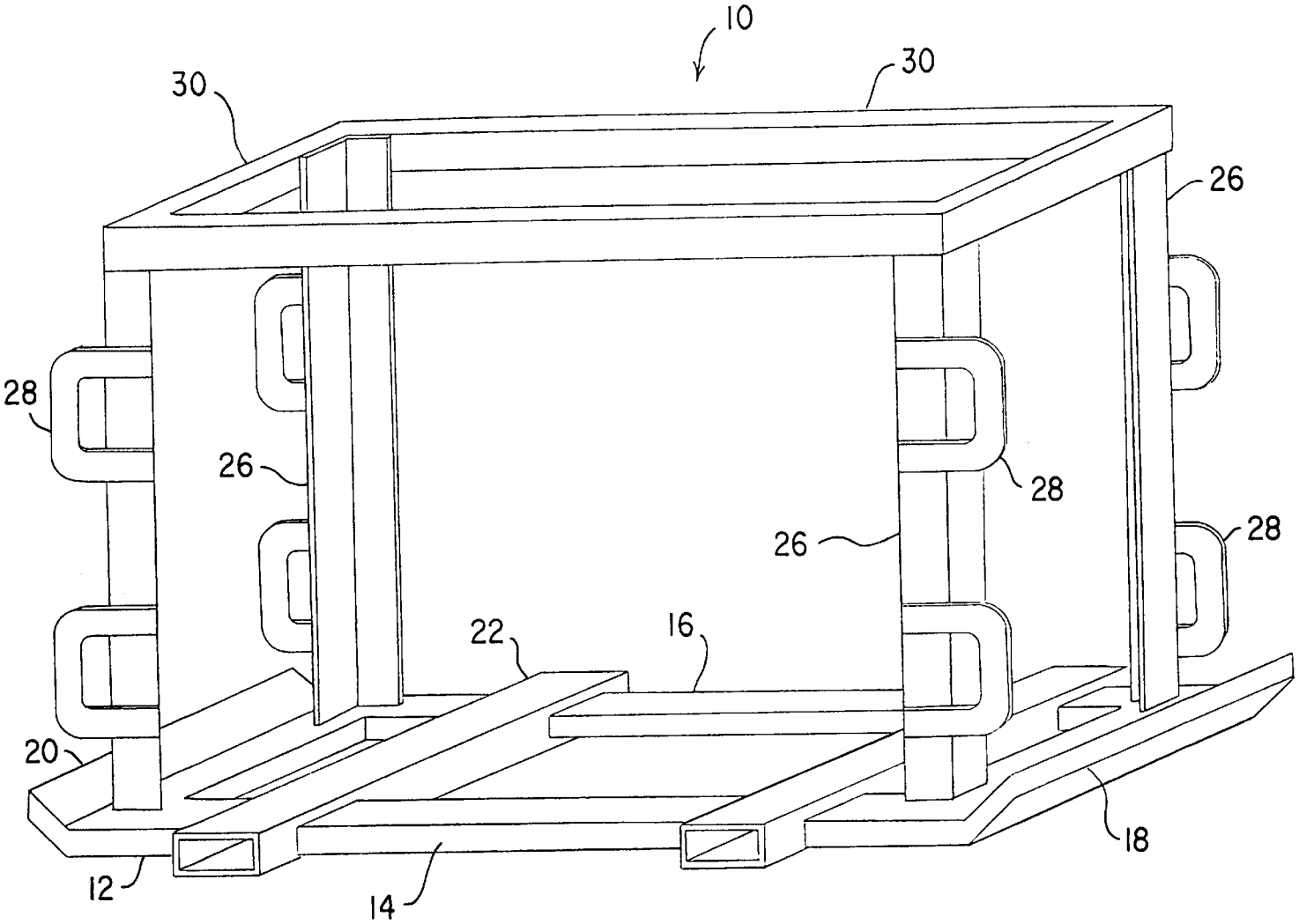
FIG. 1 is a perspective view of a preferred embodiment of the equipment skid and cage structure according to the present invention.

The present invention, as shown in its preferred embodiment in FIG. 1, is generally indicated by reference character 10. The invention comprises a skid 12 of rectangular configuration having sides 14, 16 and ends 18, 20. The ends 18, 20 are joined to the sides in a manner to form an angle with the horizontal. This design prevents the ends of the skid from digging into the floor of a transporting vehicle. The angled ends also function to keep heavy loads from tilting over. The width and length of skid 12 are determined by the width and length of the equipment that will be loaded on the skid. Lift tubes 22 and 24 traverse sides 14 and 16 and are welded thereto. Tubes 22 and 24 are open at both ends and are sized to accommodate the tines of a fork-lift truck. The tubes are spaced so that the skid will be balanced when lifted. The ends, sides, and lift tubes are fabricated from square tubular metal stock (iron, steel, aluminum, etc.).

Angle irons 26 are vertically positioned adjacent each corner of skid 12 and have lower ends welded or bolted to the skid. Each vertical angle iron 26 is provided with one or more tie-down arms 28. Tie-down arms 28 are utilized to fasten skid structures together and/or to the walls and floor of a transporting vehicle.

Horizontally positioned angle irons 30 encompass the top ends of vertical irons 26 to form a cage-like structure disposed on skid 12. Horizontal irons 30 and tie-down arms 28 are welded or bolted to vertical angle irons 26. The dimensions of the cage structure are also determined by the dimensions of the equipment to be loaded.

Figure 2:
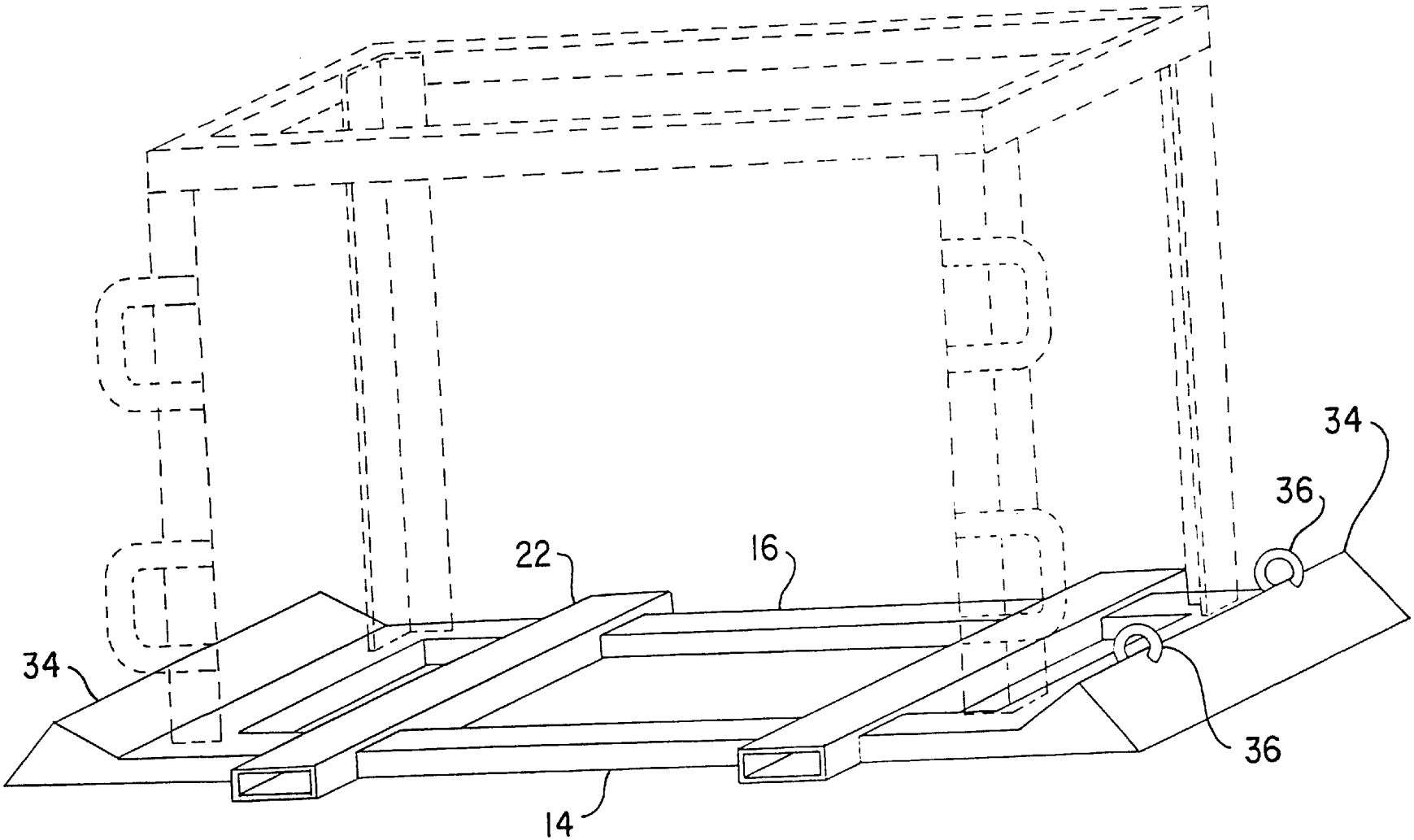
FIG. 2 is a perspective view of a first embodiment of the equipment skid according to the present invention.

It is obvious that the skid and cage of the present invention can be modified for adaptation to various transporting problems. For example, the skid of FIG. 2 is provided with wheel chocks 34 at each end to prevent equipment from sliding off the ends. Hooks 36 are welded to the chocks and are adapted to receive the chains from a winch or the like to pull the skid along a surface. The skid of FIG. 2 may also employ the cage structure of the preferred embodiment (shown in phantom lines) if desired.

Figure 3:
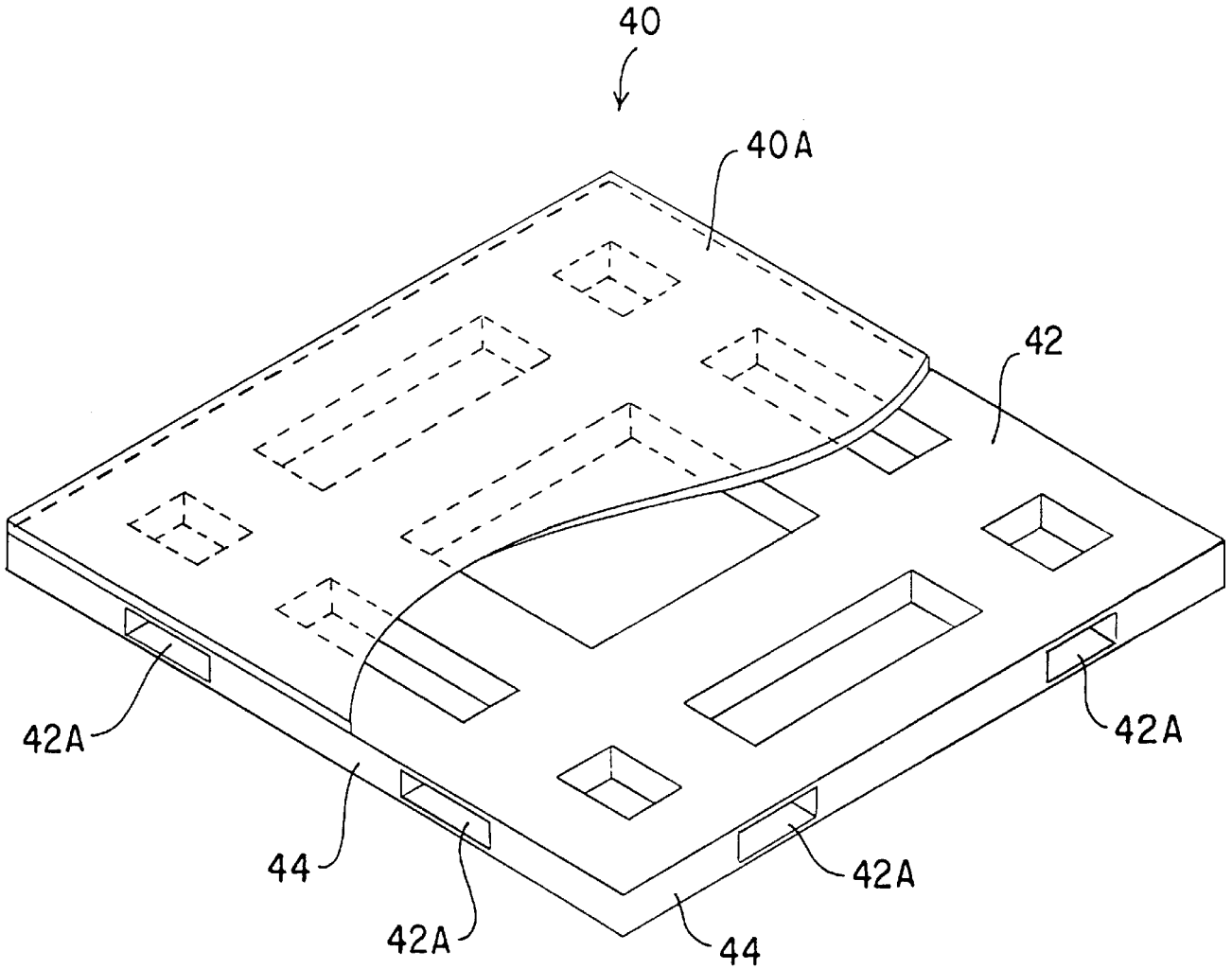
FIG. 3 is a perspective view, with portions cut away, of a second embodiment of the equipment skid according to the present invention

FIG. 3 illustrates a skid 40 having a planar, metal horizontal surface 40*a* which covers the upper surfaces of lift tubes 42. Skid 40 is designed with flat vertical planar faces 44 on each side and each end (only one of each shown). Lift tubes 42 present openings 42*a* on each side and each end. Openings 42*a* are flush with planar faces 44. This arrangement enhances versatility in storing and handling.

Figure 4:
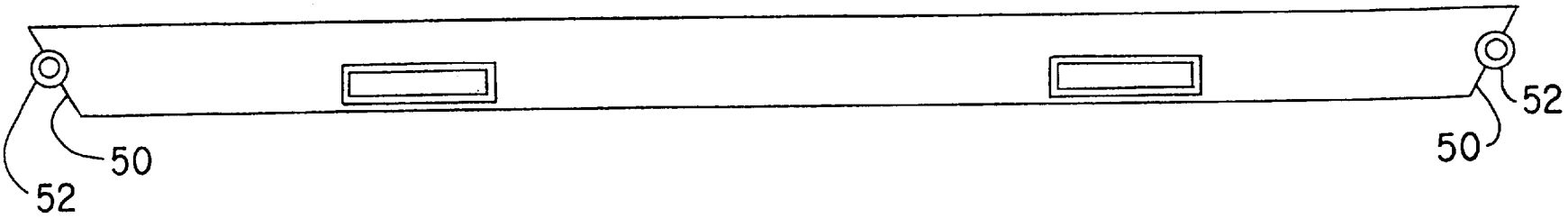
FIG. 4 is a side view of a third embodiment of the equipment skid according to the present invention.

The skid of FIG. 4 illustrates an embodiment wherein the angled end appears as a slanted surface 50. Hooks 52 are bolted or welded to surface 50. Although only one is shown on each surface, there are at least two hooks secured to each surface 50. As indicated above, hooks 52 are adapted to accept the chains from a winch or the like to pull the skid along a surface.

Figure 5:
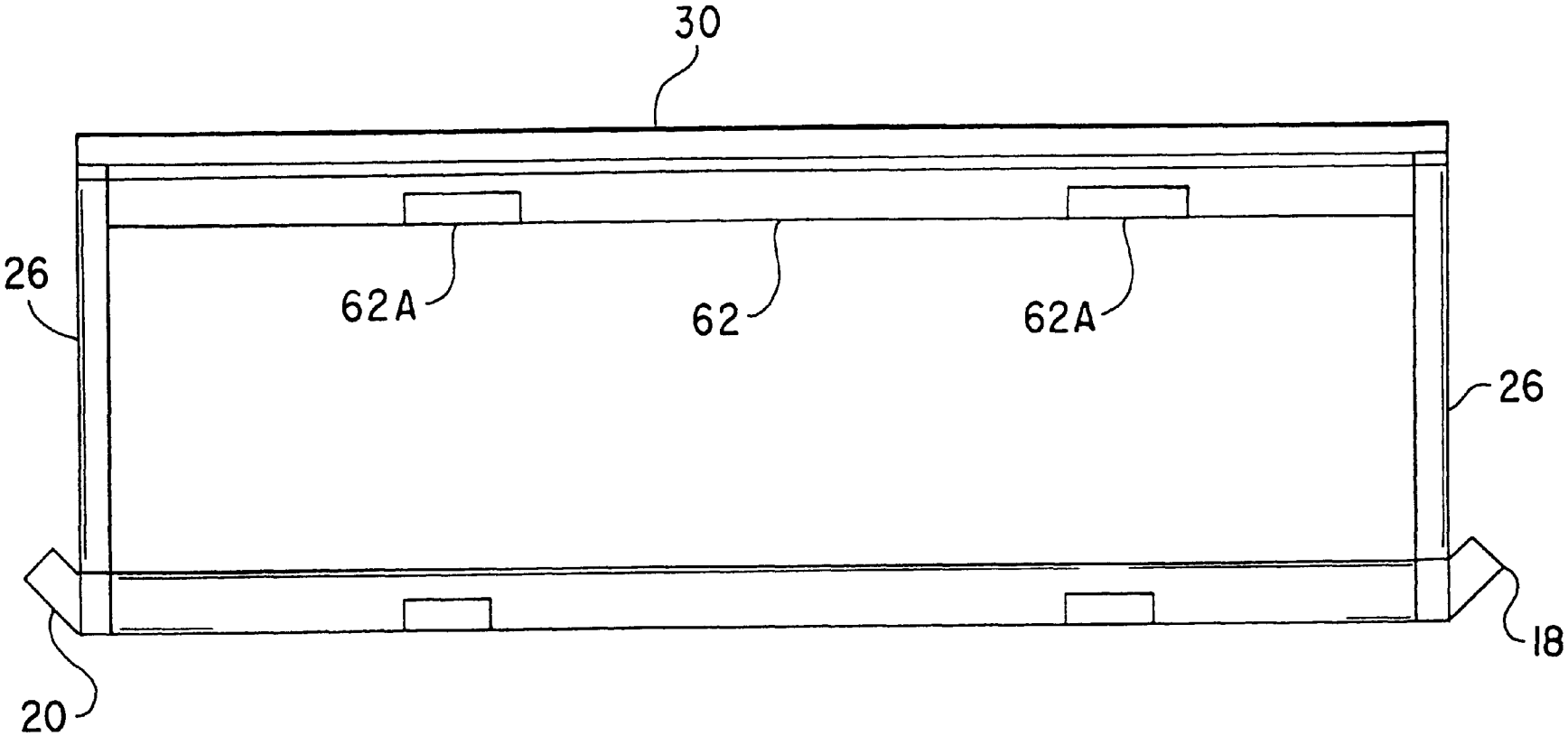
FIG. 5 is a side view of a fourth embodiment of the equipment skid According to the present invention.

The skid as illustrated in FIG. 5 incorporates heavy support beams 62 (only one is shown) attached to the angle irons at the top along each side of the cage structure. Fork lift tubes 62*a* are provided for beams 62 so that the skid and cage structure may conveniently be lifted from the top or bottom. The fork lift tubes 62*a* will be of a size to support the weight of the loaded skid. As presently contemplated, permissible weight and/or lifting capacity will be stamped on each skid.

Figure 6:
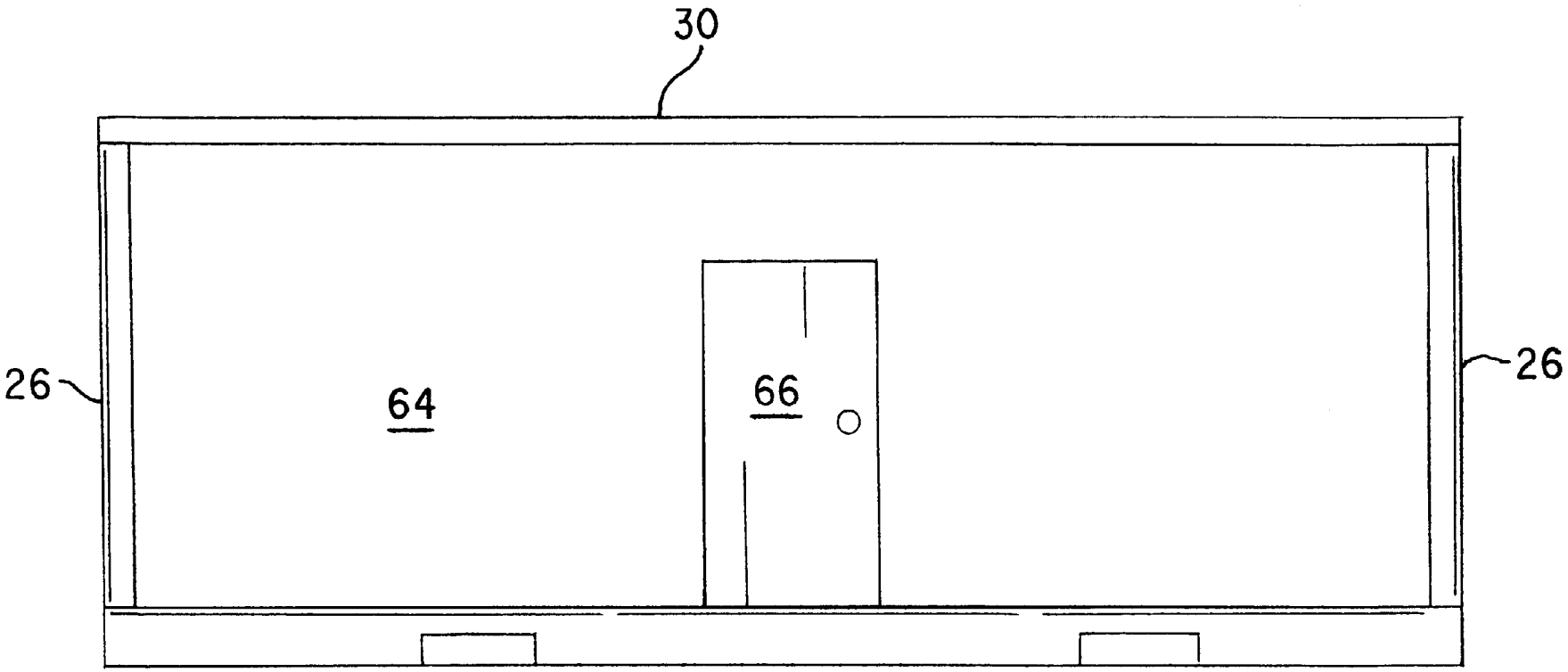
FIG. 6 is a side view of a fifth embodiment of the equipment skid according to the present invention.

The variation as illustrated in FIG. 6 depicts a skid which is especially useful when the items or equipment to be shipped require complete enclosure for proper protection. Although only one wall 64 is shown in the side view of FIG. 6, it should be recognized that both sides, both ends and the top of the structure are provided with similar walls to form an enclosed skid structure. Walls 64 are fabricated of sheet metal and may be bolted or welded to the skid and angle irons as desired. A door 66 may be included in at least one of the metal walls 64. Door 66 will provide for easy access to the enclosure for inspection of the items or equipment.

It should recognized that the features of the various embodiments can be interchanged to fashion a skid structure adaptable to the configuration of a particular transport vehicle. For example, tie-down arms may be positioned on the skid or cage at any necessary position. Also, fork-lift tubes may be included on the sides and ends of any skid. It is contemplated that the angle irons may be angularly adjusted from the vertical to adapt the skid so that it securely supports pipes or other long cylindrical items. It is also contemplated that the skid can be provided with upright columns and adjustable arms for supporting lumber or plywood sheets and the like. The skid and cage assembly may be designed to accommodate almost any equipment item(s).

It is to be understood that the present invention is not limited to the embodiments described above, but encompasses any and all embodiments within the scope of the following claims.

I claim:

1. An equipment support structure comprising:

a skid, said skid having two spaced, parallel, side members, each side member having planar bottom and top surfaces, said side members fabricated from square metal tubing;

two spaced, parallel end members, each end member having planar bottom and top surfaces, wherein said planar bottom and top surfaces of each said two spaced parallel end members form obtuse angles with the respective planar bottom and top surfaces of each said two spaced parallel side members, said end members fabricated from square metal tubing, said end members perpendicularly joining said side members whereby to form a structure of rectangular configuration;

two spaced, parallel cross members, each cross member having planar bottom and top surfaces, each cross member having a first end and a second end, said cross members fabricated from square metal tubing, said cross members positioned between said two spaced parallel end members and perpendicularly intersecting said side members;

an accessible opening formed in each said first end and said second end of said cross members, each said accessible opening spaced a distance to receive a tine of a fork-lift truck.

2. An equipment support structure according to claim 1 wherein means for stabilizing equipment is disposed on the planar top surfaces of said spaced parallel side members and said spaced parallel end members.

3. An equipment support structure according to claim 2 wherein said means comprises vertically oriented angle irons, said vertically oriented angle irons having upper and lower ends, said lower ends attached to said planar top surfaces;

horizontally oriented angle irons, said horizontally oriented angle irons being secured to the upper ends of said vertically oriented angle irons thereby forming a cage-like structure to surround and stabilize the equipment.

4. An equipment support structure according to claim 3 wherein tie-down handles are secured to said angle irons.

5. An equipment support structure comprising:

a skid, said skid having two spaced, parallel, side members, each side member having planar bottom and top surfaces, said side members fabricated from square metal tubing;

two spaced, parallel end members, each end member having planar bottom and top surfaces, wherein the planar top surface of each said two spaced parallel end members form an obtuse angle with the respective planar top surface of each said two parallel side members, said end members fabricated from square metal tubing, said end members perpendicularly joining said side members whereby to form a structure of rectangular configuration;

two spaced, parallel cross members, each cross member having planar bottom and top surfaces, each cross member having a first end and a second end, said cross members fabricated from square metal tubing, said cross members positioned between said two spaced parallel end members and perpendicularly intersecting said side members;

an accessible opening formed in each said first end and said second end of said cross members, each said accessible opening spaced a distance to receive a tine of a fork-lift truck.

6. An equipment support structure according to claim 5 wherein at least two hooks are secured to one of said two spaced parallel end members.

7. An equipment support structure according to claim 6 wherein means for stabilizing equipment is disposed on the planar top surfaces of said spaced parallel side members and said spaced parallel end members.

* * * * *